US007874883B2

(12) United States Patent
Rui

(10) Patent No.: US 7,874,883 B2
(45) Date of Patent: Jan. 25, 2011

(54) SYSTEM FOR STEERING AND MANEUVERING A WATERCRAFT PROPELLED BY A WATER JET

(75) Inventor: Yuting Rui, Ann Arbor, MI (US)

(73) Assignee: Surfango, Inc., Ypsilanti, MI (US)

( * ) Notice: Subject to any disclaimer, the term of this patent is extended or adjusted under 35 U.S.C. 154(b) by 374 days.

(21) Appl. No.: 11/939,570

(22) Filed: Nov. 14, 2007

(65) Prior Publication Data

US 2009/0124144 A1 May 14, 2009

(51) Int. Cl.
*B63H 11/107* (2006.01)

(52) U.S. Cl. ..... 440/40; 440/62

(58) Field of Classification Search ..... 440/40–42, 440/62, 63; 74/500.5–502.6, 63–69; 114/160
See application file for complete search history.

(56) References Cited

U.S. PATENT DOCUMENTS

| | | | | |
|---|---|---|---|---|
| 2,434,700 | A | | 1/1948 | Keckley |
| 3,043,260 | A | | 7/1962 | Tank |
| 3,262,413 | A | | 7/1966 | Douglas et al. |
| 3,292,373 | A | | 12/1966 | Tado |
| 3,324,822 | A | | 6/1967 | Carter, III |
| 3,369,518 | A | | 2/1968 | Jacobson |
| 3,403,578 | A | * | 10/1968 | Morse ..... 74/500.5 |
| 3,408,976 | A | | 11/1968 | Ellis |
| 3,426,724 | A | | 2/1969 | Jacobson |
| 3,463,116 | A | | 8/1969 | Dawson |
| 3,481,303 | A | | 12/1969 | Tate et al. |
| 3,521,501 | A | * | 7/1970 | Kiekhaefer ..... 74/480 B |
| 3,548,778 | A | | 12/1970 | Von-Smagala-Romanon |
| 3,608,512 | A | | 9/1971 | Thompson |
| 3,659,475 | A | * | 5/1972 | Nichols ..... 74/480 B |
| 3,675,612 | A | * | 7/1972 | Pfeiffer ..... 440/42 |
| 3,841,257 | A | * | 10/1974 | Strang ..... 440/63 |
| 3,854,437 | A | | 12/1974 | Stansbury |
| 3,882,815 | A | | 5/1975 | Bennett |
| 3,906,885 | A | | 9/1975 | Woodfill |

(Continued)

FOREIGN PATENT DOCUMENTS

FR 2617793 2/1989

(Continued)

OTHER PUBLICATIONS

International Search Report issued in corresponding International (PCT) Patent Application No. PCT/US2008/083548 (Apr. 23, 2009).

(Continued)

*Primary Examiner*—Ed Swinehart
(74) *Attorney, Agent, or Firm*—St. Onge Steward Johnston & Reens LLC

(57) ABSTRACT

A system for steering a watercraft propelled by a water jet includes a control lever supported to pivot rightward and leftward about a first control axis, a nozzle supported on the watercraft to pivot rightward and leftward and through which water is discharged from the watercraft, first and second cables, and a steering module interconnected by the cables to the control lever and connected to the nozzle, supported to pivot laterally about a second control axis and to pivot the nozzle laterally in response to pivoting of the control lever about the first control axis.

14 Claims, 5 Drawing Sheets

U.S. PATENT DOCUMENTS

| | | | |
|---|---|---|---|
| 4,020,782 | A | 5/1977 | Gleason |
| 4,047,494 | A | 9/1977 | Scott |
| 4,229,850 | A | 10/1980 | Arcouette |
| 4,231,315 | A | 11/1980 | Tachibana et al. |
| 4,237,812 | A | 12/1980 | Richardson |
| 4,274,357 | A | 6/1981 | Dawson |
| 4,321,048 | A | 3/1982 | Marchese et al. |
| 4,457,724 | A | 7/1984 | Miyamoto |
| D276,994 | S | 1/1985 | Montgomery et al. |
| 4,497,631 | A | 2/1985 | Belanger |
| 4,538,996 | A | 9/1985 | Inwood |
| 4,589,365 | A | 5/1986 | Masters |
| 4,765,075 | A | 8/1988 | Nakase et al. |
| 4,781,141 | A | 11/1988 | Webb et al. |
| 4,832,632 | A | 5/1989 | Rogozienski |
| 4,942,838 | A | 7/1990 | Boyer et al. |
| 5,017,166 | A | 5/1991 | Chang |
| 5,096,446 | A | 3/1992 | Tazaki et al. |
| 5,209,683 | A | 5/1993 | Imaeda et al. |
| 5,254,024 | A | 10/1993 | Kobayashi et al. |
| 5,481,997 | A | 1/1996 | Arndt |
| 5,582,529 | A | 12/1996 | Montgomery |
| 5,628,269 | A | 5/1997 | Henmi et al. |
| 2009/0241823 | A1* | 10/2009 | Borrett ..... 114/151 |

FOREIGN PATENT DOCUMENTS

| | | |
|---|---|---|
| JP | 1148694 | 6/1989 |
| JP | 3295791 | 1/1991 |

OTHER PUBLICATIONS

Written Opinion issued in corresponding International (PCT) Patent Application No. PCT/US2008/083548 (Apr. 23, 2009).
English language machine translation of FR2617793 obtained from European Patent Office website (www.espacenet.com).
English language abstract for JP 1148694 obtained from European Patent Office website (www.espacenet.com).
English language abstract for JP 3295791obtained from European Patent Office website (www.espacenet.com).

* cited by examiner

SYSTEM FOR STEERING AND MANEUVERING A WATERCRAFT PROPELLED BY A WATER JET

FIELD OF THE INVENTION

This invention relates generally to a boat propelled by a water jet. In particular, the invention pertains to a kayak-like watercraft that is steered and maneuvered by directing a nozzle through which the water jet is discharged.

BACKGROUND OF THE INVENTION

A jet-boat is a boat propelled by a jet of water ejected from the back of the craft. Unlike a powerboat or motorboat that uses a propeller in the water behind the boat, a jet-boat draws the water from under the boat into a pump-jet inside the boat, then expels the injected water through a nozzle at the stern.

Jet-boats are steered and maneuvered by directing the nozzle and water jet laterally from the longitudinal axis of the craft, such that the water jet both propels and steers the craft. Jet boats can be reversed and brought to a stop within a short distance from full speed using the jet.

A conventional screw impeller accelerates a large volume of water by a small amount, similar to the way an airplane's propeller accelerates a large volume of air by a small amount. In a jet-boat, pumping a small volume of water, accelerating it by a large amount, and expelling the water above the water line delivers thrust that propels the craft. Acceleration of the water is achieved by the impeller driven by a small ICE onboard the craft.

SUMMARY OF THE INVENTION

A system for steering a watercraft propelled by a water jet includes a control lever supported to pivot rightward and leftward about a first control axis, a nozzle supported on the watercraft to pivot rightward and leftward and through which water is discharged from the watercraft, first and second cables, and a steering module interconnected by the cables to the control lever and connected to the nozzle, supported to pivot laterally about a second control axis and to pivot the nozzle laterally in response to pivoting of the control lever about the first control axis.

The rider sits on the upper deck of the boat's hull with legs extended along the deck and straddling the control lever. The control lever is simple and intuitive to operate and is conveniently located within easy reach of the rider. The control lever can be stowed away when the craft is being stored or transported.

An accelerator for adjusting engine speed and starting and stopping the engine are located on the control lever. The craft is steered and maneuvered by pivoting the control lever rightward and leftward, thereby causing the nozzle to pivot and direct the water jet in a direction that causes the watercraft to turn in the direction that the lever is pivoted.

The control lever and its interconnection to the nozzle are direct and reliable, has few moving parts, is of low cost, and can be installed and assembled easily.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

The invention will be more readily understood by reference to the following description, taken with the accompanying drawings, in which.

DETAILED DESCRIPTION OF THE INVENTION

Figure 1:
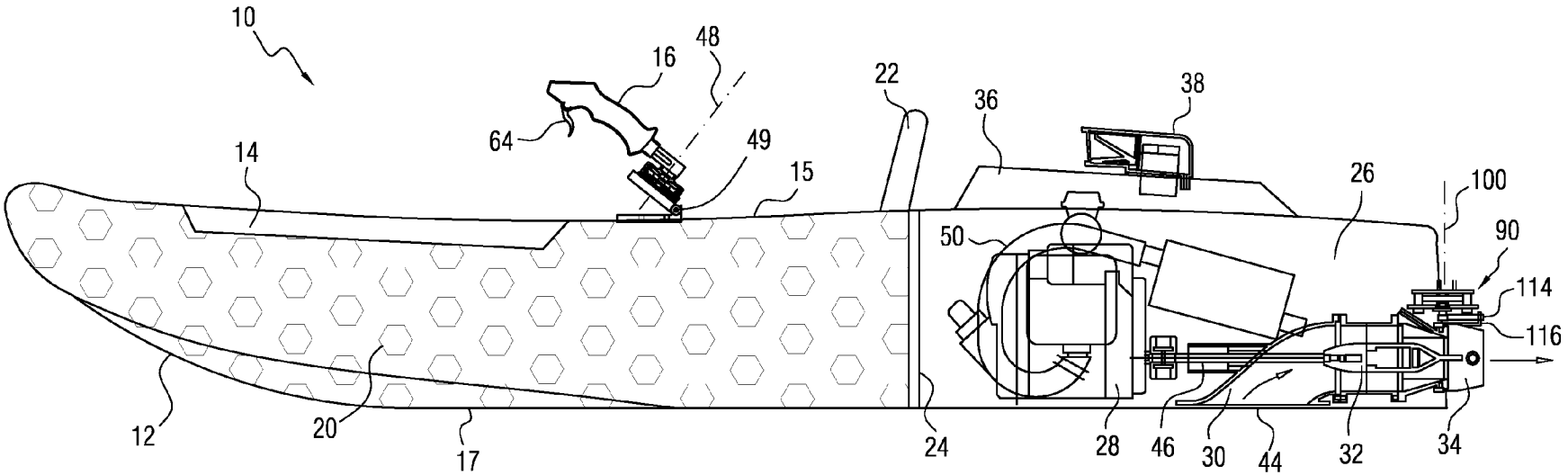
FIG. 1 is a cross-sectional side view of an engine-powered kayak showing the water induction system and engine.

Referring now to FIG. 1, a kayak 10 includes a sealed hull portion 12 covered with a seamless molded plastic skin, the hull being formed with a recess 14 on its upper surface 15, in which recess the rider sits facing forward with legs straddling a manually-operated control lever 16 (called a joystick) and feet supported on foot rests. The volume of hull 12 between its upper deck 15 and its bottom surface 17 is filled with a core material 20 that reinforces, strengthens and stiffens the hull. The core 20 may be expandable, cellular molded foam or a hollow, hexangular honeycomb whose walls are of Kevlar or a similar synthetic material. Alternatively, the core may be formed of machined foam. The hull portion 12 is sealed, thereby preventing entry of water from waves or spray and making it possible to roll the kayak upright again following a tip over without it filling with water.

A seat back 22, secured to the upper surface of the hull 12 supports the seated rider. The core-reinforced portion of the hull 12 is closed by a partition or bulkhead 24, located at the forward end of an engine compartment 26, which contains an engine 28, water intake duct 30, bladed impeller 32 that forces water from the intake duct, and a nozzle 34, whose angular position about a vertical axis can be varied leftward and rightward to steer the kayak 10. Water inducted through duct 30 flows through the impeller and exits through the nozzle 34. The engine compartment 26 is covered with a cowling 36 formed with an air inlet passageway 38. Cowling 36 is secured by latches to the upper surface of the hull, thereby sealing the engine compartment against entry of water when the cowling is latched to the hull. Preferably, engine 28 has a single cylinder and piston, low displacement and operates at high efficiency on a four stroke cycle.

The intake duct 30, which may be a component separate from the hull 12 or formed integrally with the hull, is of molded plastic having an intake opening 44 in the bottom of the hull, through which water is inducted and flows toward the outlet of nozzle 34. A driveshaft 46, secured to the crankshaft 47 of engine 28 drives the bladed impeller 32 in rotation, thereby drawing water into the intake duct 30 and forcing it through the impeller and out the nozzle 34. A water jet, which propels and steers the kayak 10, rises from the outlet of nozzle 34 into the air above the water surface.

The rider pivots the joystick 16 leftward and rightward about first control axis 48 to steer the craft 10. The joystick 16 carries a button 50, which is depressed to start engine 28, a button 52 that stops the engine, and an engine throttle in the form of a trigger 64 located on the underside of the joystick, by which the engine throttle is opened and closed to control engine speed and the speed of the kayak 10.

The rider also pivots the joystick 16 upward and downward about horizontal axis 49 to locate its hand grip in a comfortable position during use and in a downward position when the craft 10 is stored or being transported.

As control lever 16 pivots rightward and leftward about first control axis 48, cables 54, 56 transmit movement of the lever 16 to the nozzle 34, which pivots leftward and rightward, respectively, in response to movement of the lever, thereby steering and maneuvering the kayak 10 by redirecting the water jet exiting the nozzle rightward and leftward relative to the longitudinal axis of the craft. Cables 54, 56 may be similar to the type used manually to actuate the brakes of a bike.

Figure 2:
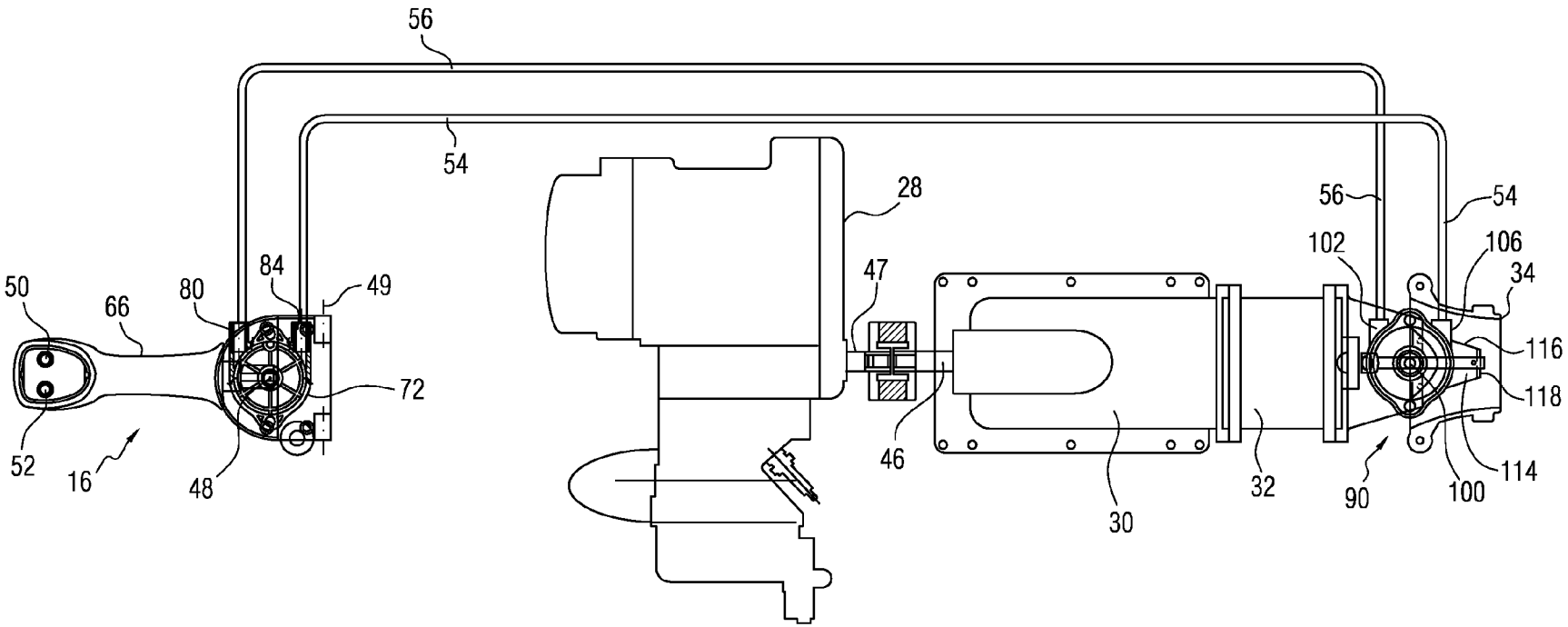
FIG. 2 is schematic top view of the steering system.
Figure 3:
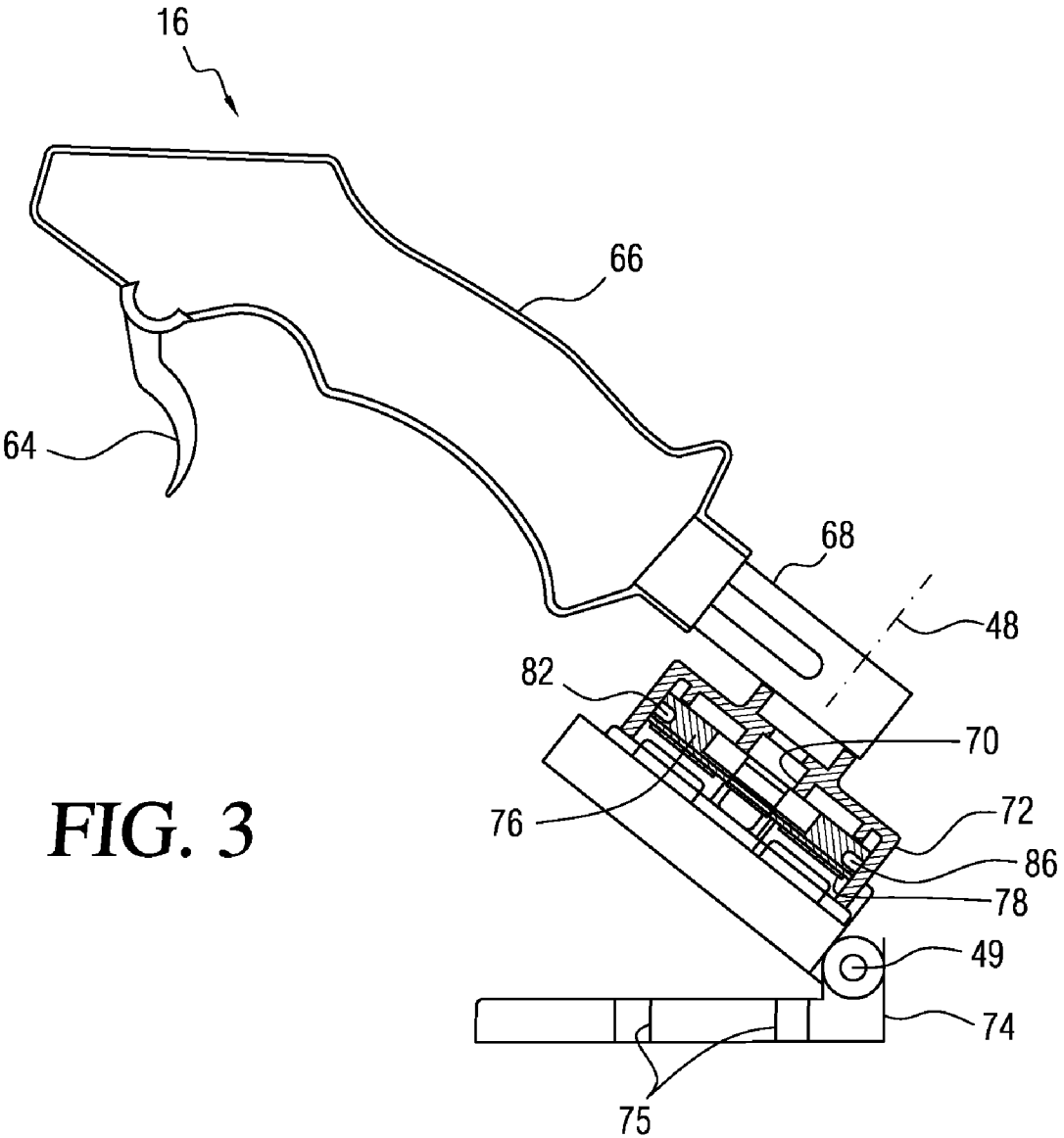
FIG. 3 is a side view partially in cross section showing the control lever and a forward steering module.

FIGS. 2 and 3 show that the hand grip 66 of control lever 16 carries a extension 68, which is attached by a bolt fitted into a central hole 70 and engaged with a support 72, which supports lever 16. Support 72 is secured to a control lever bracket 74, which is fixed at bolt holes 75 to the surface of the upper deck 15 of the hull 12. Support 72 provides the horizontal axis 49, about which control lever 16 pivots upward and downward. Support 72 also pivots about first control axis 48 as the rider applies lateral force to control lever 16 to steer the kayak 10.

A control lever rotary disc 76, seated in a recess 78 formed in support 72, 5 pivots about first control axis 48 in response to pivoting of lever 16. One end of cable 56 enters a laterally passageway 80, formed in support 72, and is secured at 82 to the control lever rotary disc 76. One end of cable 54 enters a laterally passageway 84, formed in support 72, and is secured at 86 to the control lever rotary disc 76. Cables 54, 56 are preferably constructed of twisted strands of steel encased in a plastic tube, which supports the 10 cables against compression instability when a compressive force is applied to the steel strands.

Figure 4:
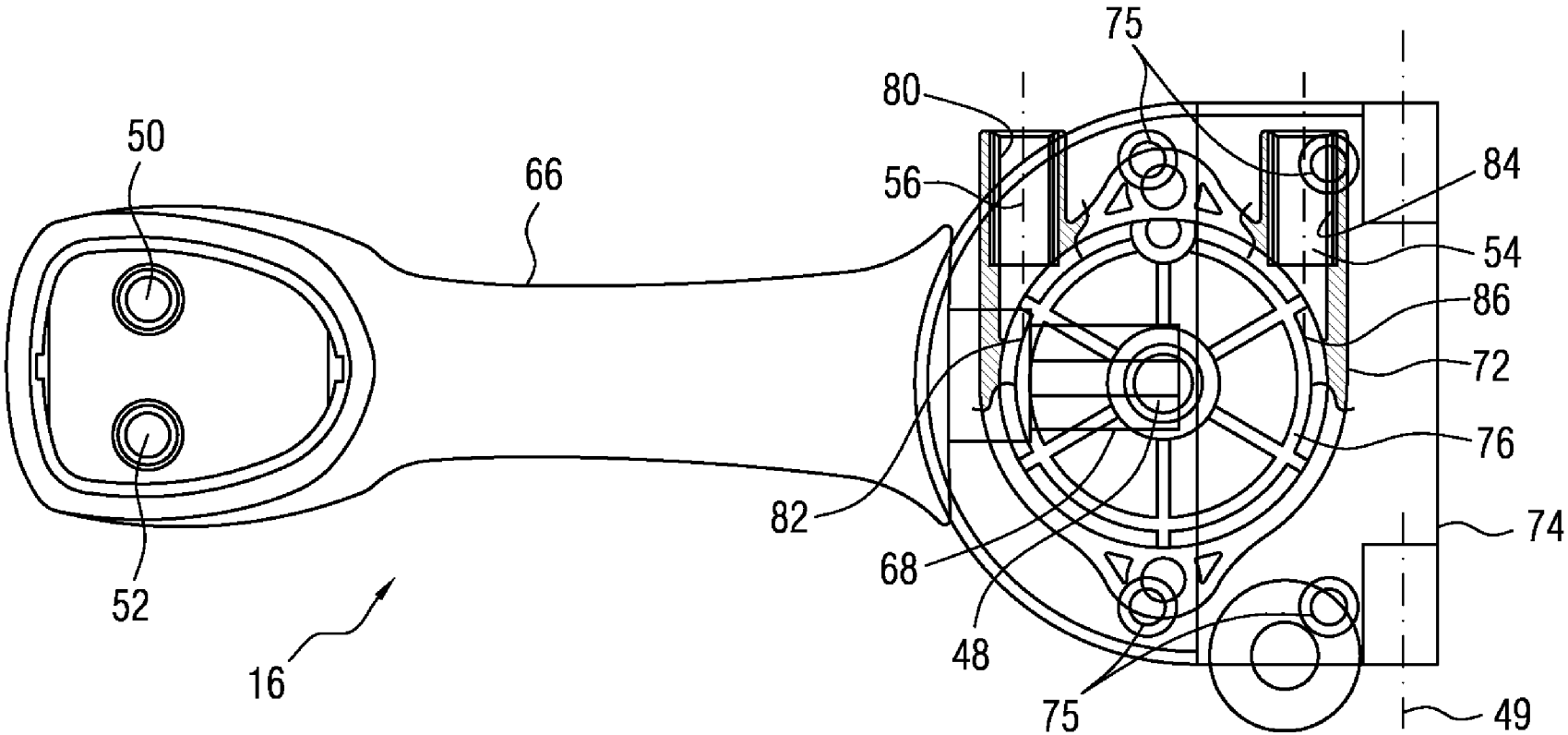
FIG. 4 is a top view, partially in cross section, of the control level shown in FIG. 3.

When control lever 66 pivots clockwise as seen in FIGS. 2 and 4, tension force is applied to cable 54 and compression force is applied to cable 56 as control lever rotary disc 76 rotates about first control axis 48. When control lever 66 pivots counterclockwise as seen in FIGS. 2 and 4, tension force is applied to cable 56 and compression force is applied to cable 54 as control lever disc 76 rotates about first control axis 48.

Figure 6:
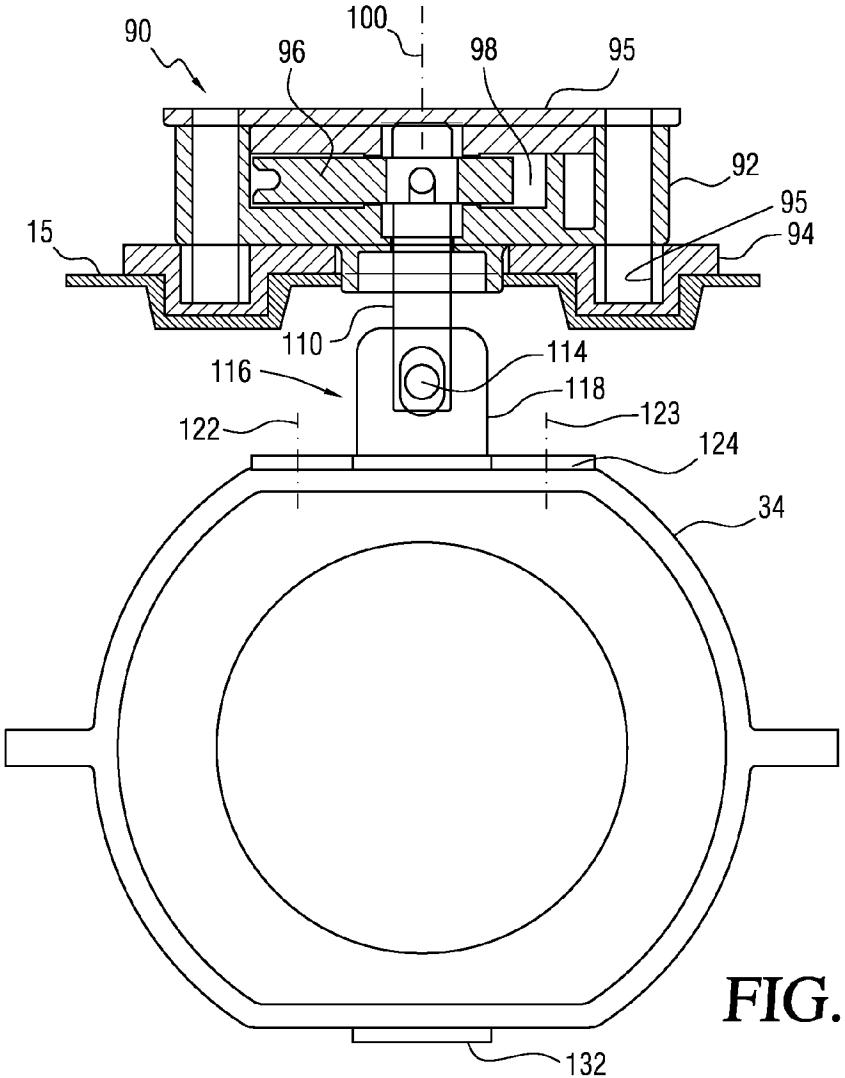
FIG. 6 is an end cross sectional view showing the rear steering module and nozzle disposed as shown in FIG. 5.
Figure 5:
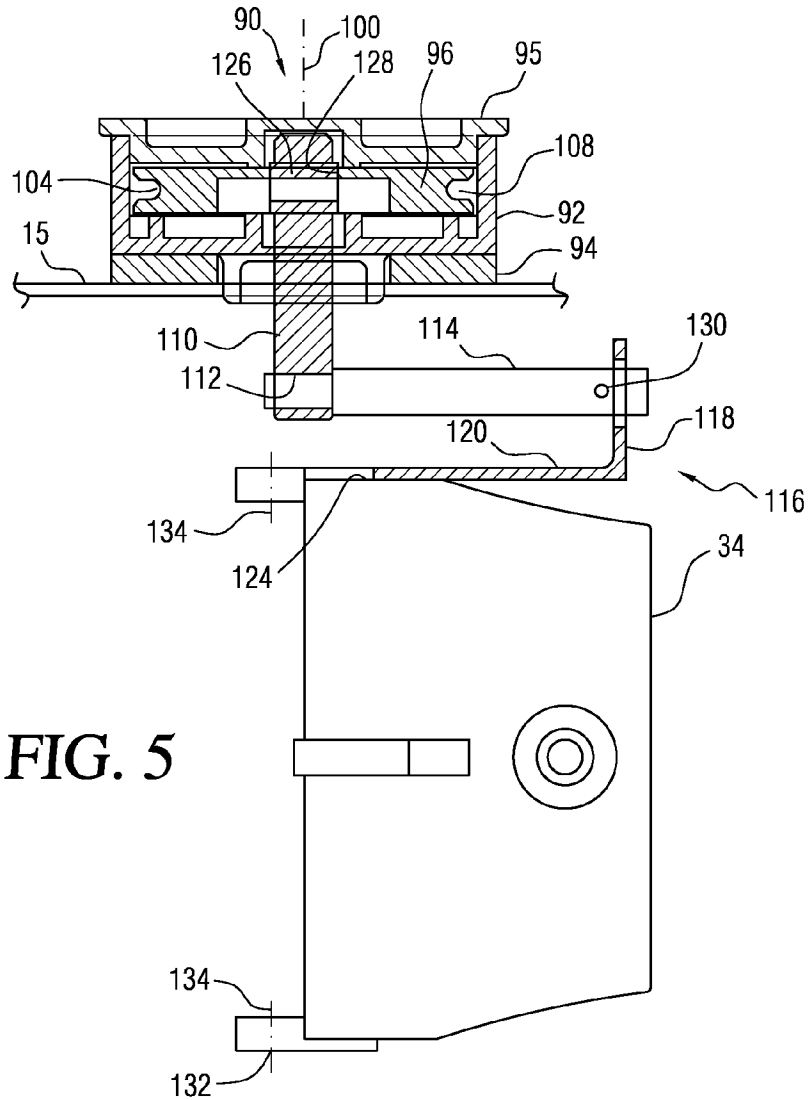
FIG. 5 is a side cross sectional view showing the rear steering module and nozzle aligned with the longitudinal axis of the craft.

FIGS. 5 and 6 show a steering control module 90 connected to the opposite ends of cables 54, 56 for directing nozzle 34 laterally in response to movement of the control lever 16. A support 92 is secured to a bracket 94, which is fixed at bolt holes 95 to the surface of the upper deck 15 of the hull 12. A cover 95 closes the upper surface of support 92.

A nozzle rotary disc 96, seated in a recess 98 formed in support 92, pivots about a vertical second control axis 100 in response to pivoting of lever 16. The opposite end of cable 56 from the end that is attached to control lever disc 76 enters a laterally passageway 102, formed in support 92, and is secured at 104 to the nozzle disc 96. The opposite end of cable 54 from the end that attaches to control lever disc 76 enters a laterally passageway 106, formed in support 72, and is secured at 108 to the nozzle rotary disc 76.

A pin 110 is fitted into holes aligned with second control axis 100 and formed in cover 95, support 92, nozzle disc 96 and bracket 94. The lower end of pin 110 is formed with a lateral hole that is engaged by a lateral pin 114. Pin 110 is formed with a shoulder 126, which is fitted in a hole 128 in nozzle disc 96, thereby fixing pin 110 and nozzle disc 96 mutually for rotation as a unit about second control axis 100.

An nozzle bracket 116 includes a vertical leg 118 having a hole that is engaged by pin 114, and a horizontal leg 120 secured by two screws 122, 123 to the upper surface 124 of nozzle 34. A transverse pin 130, such as a cotter pin, passes through pin 114 and prevents inadvertent disconnection of nozzle bracket 116 from pin 110.

When control lever 16 pivots rightward about first control axis 48, as seen in FIGS. 2 and 4, tension force applied to cable 54 is transmitted to rear disc 96, thereby causing nozzle disc 96, pin 110 and pin 114 to rotate counterclockwise about second control axis 100. As pin 114 rotates, nozzle bracket 116 rotates counterclockwise forcing nozzle 34 to turn counterclockwise about second control axis 100, thereby directing the water jet exiting the nozzle 34 rightward causing the kayak to turn rightward, i.e., in the same direction as the control lever 16 is pivoted by the rider. Nozzle 34 is supported at 132 for rotation about a nozzle axis 134, which may be aligned with second control axis 100 or eccentric of second control axis 100.

When control lever 66 pivots leftward about first control axis 48, as shown in FIGS. 2 and 4, tension force applied to cable 56 is transmitted to nozzle disc 96 causing nozzle disc 96, pin 110 and pin 114 to rotate clockwise about second control axis 100. As pin 114 rotates clockwise, nozzle bracket 116 rotates clockwise forcing nozzle 34 to turn clockwise, thereby directing the water jet exiting the nozzle 34 to the left and causing the kayak to turn to the left, i.e., in the same direction as the control lever 16 is pivoted by the rider.

Preferably pin 114 and nozzle bracket 116 are made from stainless steel, and support 92 is made from ABS reinforced with 20 percent fiber glass by volume.

Cables 54, 56 may be replaced by any suitable connectors able to transmit movement of the control lever 16 to the nozzle disc 96 including, but not limited to connecting rods, ropes and wires.

In accordance with the provisions of the patent statutes, the preferred embodiment has been described. However, it should be noted that the alternate embodiments can be practiced otherwise than as specifically illustrated and described.

What is claimed is:

1. A system for steering a watercraft propelled by a water jet comprising:

a control lever supported to pivot rightward and leftward relative to a longitudinal axis of the watercraft about a first control axis;

a nozzle through which the water jet is discharged from the watercraft, the nozzle being supported to pivot rightward and leftward relative to the longitudinal axis of the watercraft;

first and second cables;

a control lever disc connected to the control lever and supported to rotate about the first control axis with the control lever, secured to a first end of the first cable eccentric of the first control axis, and secured to a first end of the second cable eccentric of the first control axis;

a nozzle disc driveably connected to the nozzle and supported to rotate about a second control axis, secured to a second end of the first cable eccentric of the second control axis, and secured to a second end of the second cable eccentric of the second control axis, and directing the water jet laterally in response to movement of the control lever about the first control axis;

wherein the nozzle pivots about a nozzle axis that is offset from the second control axis.

2. The system of claim 1 wherein;

the nozzle disc directs the nozzle leftward relative to the longitudinal axis of the watercraft in response to rightward movement of the control lever about the first control axis; and the nozzle disc directs the nozzle rightward relative to the longitudinal axis of the watercraft in response to leftward movement of the control lever about the first control axis.

3. The system of claim 1 further comprising:

a hull; and a control lever bracket secured to the hull, providing the first control axis, and providing a horizontal axis about which the control lever pivots upward and downward.

4. The system of claim 1 further comprising:

a mechanism for transmitting rotation of the nozzle disc to the nozzle including a first pin concentric with the second control axis and secured to the nozzle disc for rotation therewith, a nozzle bracket secured to the nozzle, and a second pin extending radially from the first pin and engaged with the nozzle bracket eccentric of the second control axis.

5. A system for steering a watercraft propelled by a water jet comprising:

a control lever supported to pivot rightward and leftward relative to a longitudinal axis of the watercraft about a first control axis;

a nozzle through which the water jet is discharged from the watercraft, the nozzle being supported to pivot rightward and leftward relative to the longitudinal axis of the watercraft;

first and second cables;

a steering module interconnected by the cables to the control lever, connected to the nozzle, and supported to rotate about a second control axis, for directing the water jet laterally in response to movement of the control lever about the first control axis, wherein the steering module comprises:

a nozzle disc driveably connected to the nozzle and supported to rotate about the second control axis, secured to a second end of the first cable eccentric of the second control axis, and secured to a second end of the second cable eccentric of the second control axis; and a mechanism for transmitting rotation of the nozzle disc to the nozzle including a first pin concentric with the second control axis and secured to the nozzle disc for rotation therewith, a nozzle bracket secured to the nozzle, and a second pin extending radially from the first pin and engaged with the nozzle bracket eccentric of the second control axis.

6. The system of claim 5 wherein;

the steering module directs the nozzle rightward relative to the longitudinal axis of the watercraft in response to rightward movement of the control lever about the first control axis; and the steering module directs the nozzle leftward relative to the longitudinal axis of the watercraft in response to leftward movement of the control lever about the first control axis.

7. The system of claim 5 further comprising:

a hull; and a control lever bracket secured to the hull, providing the first control axis, and providing a horizontal axis about which the control lever pivots upward and downward.

8. The system of claim 5 further comprising:

a control lever disc connected to the control lever and supported to rotate about the first control axis with the control lever, secured to a first end of the first cable eccentric of the first control axis, and secured to a first end of the second cable eccentric of the first control axis.

9. The system of claim 5 further comprising:

a control lever disc connected to the control lever and supported to rotate about the first control axis with the control lever, secured to a first end of the first cable at a first angular position about the first control axis and eccentric of the first control axis, and secured to a first end of the second cable eccentric of the first control axis and at a second angular position about the first control axis that is offset angularly from the first position; and wherein the nozzle disc is secured to a second end of the first cable at a first angular position about the second control axis and eccentric of the second control axis, and secured to a second end of the second cable eccentric of the second control axis and at a second angular position about the second control axis that is offset angularly from the first position.

10. The system of claim 5 wherein the nozzle pivots rightward and leftward relative to the longitudinal axis of the watercraft about a nozzle axis that is offset from the second control axis.

11. A system for steering a watercraft propelled by a water jet comprising:

a control lever supported to pivot rightward and leftward relative to a longitudinal axis of the watercraft about a first control axis;

a nozzle through which the water jet is discharged from the watercraft, the nozzle being supported to pivot rightward and leftward relative to a longitudinal axis of the watercraft;

a control lever disc connected to the control lever and supported to rotate about the first control axis as the control lever pivots;

a nozzle disc supported to rotate about a second control axis, driveably connected to the nozzle and control lever disc such that the nozzle pivots rightward in response to rightward movement of the control lever about the first control axis, and leftward in response to leftward movement of the control lever about the first control axis, rotation of the nozzle disc directing the water jet laterally in response to movement of the control lever about the first control axis; and a mechanism for transmitting rotation of the nozzle disc to the nozzle including a first pin concentric with the second control axis and secured to the nozzle disc for rotation therewith, a nozzle bracket secured to the nozzle, and a second pin extending radially from the first pin and engaged with the nozzle bracket eccentric of the second control axis.

12. The system of claim 11 further comprising:

a first connector including a first end and a second end;

a second connector including a first end and a second end, the control lever disc being secured to the first end of the first connector eccentric of the first control axis and secured to the first end of the second connector eccentric of the first control axis, the nozzle disc being secured to the second end of the first connector eccentric of the second control axis and secured to the second end of the second connector eccentric of the second control axis.

13. The system of claim 11 wherein the nozzle pivots rightward and leftward relative to the longitudinal axis of the watercraft about a nozzle axis that is offset from the second control axis.

14. The system of claim 11 further comprising:

a hull; and a control lever bracket secured to the hull, providing the first control axis, and providing a horizontal axis, about which the control lever pivots upward and downward.

* * * * *